US006922179B2

(12) United States Patent
McCollum

(10) Patent No.: US 6,922,179 B2
(45) Date of Patent: Jul. 26, 2005

(54) LOW PROFILE TELEVISION ANTENNA

(75) Inventor: Gail Edwin McCollum, Oakville, IA (US)

(73) Assignee: Winegard Company, Burlington, IA (US)

( * ) Notice: Subject to any disclaimer, the term of this patent is extended or adjusted under 35 U.S.C. 154(b) by 0 days.

(21) Appl. No.: 10/715,302

(22) Filed: Nov. 17, 2003

(65) Prior Publication Data

US 2005/0104797 A1 May 19, 2005

(51) Int. Cl.[7] ..... H01Q 1/36
(52) U.S. Cl. ..... 343/895; 343/792.5
(58) Field of Search ..... 343/895, 792.5, 343/700 MS, 853

(56) References Cited

U.S. PATENT DOCUMENTS

| | | | | | |
|---|---|---|---|---|---|
| 4,658,262 | A | | 4/1987 | DuHamel | 343/792.5 |
| 5,146,234 | A | * | 9/1992 | Lalezari | 343/895 |
| 5,313,216 | A | * | 5/1994 | Wang et al. | 343/700 MS |
| 5,589,842 | A | | 12/1996 | Wang et al. | 343/787 |
| 5,936,594 | A | * | 8/1999 | Yu et al. | 343/895 |
| 6,191,756 | B1 | * | 2/2001 | Newham | 343/895 |
| 6,211,839 | B1 | * | 4/2001 | Campbell | 343/792.5 |
| 2001/0033251 | A1 | | 10/2001 | Rudish | 343/895 |

OTHER PUBLICATIONS

Tai–Tseng Chu and H. George Oltman Jr., The Sinuous Antenna, MSN & CT, Jun. 1988, pp. 40–41, 43–44 and 46–48.

John D. Kraus, 15–3 The Frequency–Independent Planar Log–Spiral Antenna, Antennas Second Edition, 1988, pp. 697–701, McGraw–Hill, Inc., U.S.A.

Charles Rhodes, What's That Noise?, TV Technology, Jun. 25, 2003, pp. 28 and 30, vol. 21, No. 12, IMAS Publishing (USA) Inc., Falls Church, VA.

Circularly polarized T.V. Signals—What they mean to the viewer, Electronic Technician/Dealer, Mar. 1979, pp. 28–29.

Digital 101 [online], [retrieved on Jun. 24, 2003]. Retrieved from the Internet <http://www.titantvretailzone.com/rz/RetailZone/DtvFaq.asp>.

Georges A. Deschamps and Raymond H. Duhamel, Frequency–Independent Antennas, Antenna Engineering Handbook, 1961, pp. 18–1 to 18–32, First Edition, McGraw–Hill, Inc., U.S.A.

Xavier Begaud, Pierre Poey, Jean Pierre Daniel & Gerard Dubost, Design of Wideband Dual Polarized Slot Antenna, Paper presented at AP2000 Millennium Conference on Antennas & Propagation, Davos, Switzerland, Apr. 9–14, 2000.

J. E. Hershey, Wideband Antennas—A Short Survey, Aug. 22, 2000, General Electric Company, U.S.A. (23 pages).

IEEE Standard Definitions of Terms for Antennas, Jun. 21, 1993, pp. 1–28, IEEE Std 145–1993, Institute of Electrical and Electronics Engineers, Inc., New York, New York.

Internet Archive Wayback Machine [online], [retrieved on Oct. 26, 2004]. Retrieved from the Internet <URL: http://web.archive.org/web/*/http://achesonindustries.com>.

Lexan 9034 Datasheet on Uncoded Polycarbonate, GE Plastics Structured Products, circa 2003.

* cited by examiner

*Primary Examiner*—Hoang V. Nguyen
(74) *Attorney, Agent, or Firm*—Dorr, Carson, Sloan, Birney & Kramer, P.C.

(57) ABSTRACT

A television antenna formed from a pair of generally sinuous antenna arms extending outwardly from a common central axis and arranged opposite each other. The antenna arms do not interleave or touch each other. A reflector provides a separation distance between the reflector and the pair of antenna arms.

29 Claims, 10 Drawing Sheets

LOW PROFILE TELEVISION ANTENNA

BACKGROUND OF THE INVENTION

1. Field of the Invention

This invention relates to the field of antennas; and, more particularly, to external low-profile television HDTV antennas for indoor or outdoor residential and mobile use.

2. Discussion of the Background

Consumer demand for off-air television antennas has been increasing with the interest in direct broadcast satellite service subscription as an alternative to cable television subscription, and the emergence of the new Advanced Television Systems Committee (ATSC) digital television standard adopted by the Federal Communication Commission (FCC) in December 1996. The new standard allows local broadcast television stations to offer either network programming in High Definition Television (HDTV), or multicasting of programming in a digital Standard Definition television (SDTV) format on several side bands. The ATSC standard allows broadcasters to transmit over-the-air digital information at a rate of 19.4 Mbps in a 6 MHz television channel bandwidth in either the VHF or UHF radio frequency (RF) spectrum. Broadcasters have the option of utilizing the majority of the bandwidth for a single HDTV 1080*i* transmission or for several SDTV transmissions. In addition, over-the-air broadcasters may provide video and data on-demand services providing information and entertainment to subscribers over-the-air as an alternative to receiving information from point-to-point Internet service providers whose data transmissions are limited by network traffic.

Because of the large bandwidth requirement to broadcast 1080*i* HDTV programming, cable television service providers are experiencing issues in delivering broadcast network HDTV to subscribers in addition to their existing programming. Their "digital cable" services are in reality multiple channels over a community antenna television (CATV) channel bandwidth whose video resolutions are the same as those of analog video signals, significantly less than DVD quality. For this reason, only a handful of cable companies are currently providing a limited number of HDTV broadcast channels to their subscribers while working through bandwidth issues in providing additional HDTV channels. In addition, direct broadcast satellite providers who are able to provide local channels to their subscribers may only do so with the same video resolution as their relative analog broadcasts. In most markets, the only means of receiving HDTV programs on all available broadcast channels in an area is with an appropriate television antenna, and an ATSC-compatible tuner. Because some consumers do not wish to wait for cable companies to work out their bandwidth issues to provide HDTV programming for a monthly fee, a need exists for such consumers to purchase an off-air antenna to receive HDTV programming for free.

In most markets, the majority of ATSC channels available are currently in the UHF television bandwidth (470 to 806 MHz, or television channels 14–69), while continuing their National Television System Committee (NTSC) analog broadcasts on their originally assigned channels. When a high-enough market share owns ATSC-compatible televisions or set-top tuners the broadcasters will then terminate their NTSC broadcast and offer DTV broadcasting exclusively. Broadcasters with NTSC transmissions on VHF low-band (54 to 88 MHz, or channels 2–6) or VHF hi-band (174 to 216 MHz, or channels 7–13) have been given the option to retain their VHF channel for exclusive DTV broadcasting and terminating their UHF transmission, since less power and operating cost would be needed to transmit on VHF to cover the market area than UHF. However, until the time comes, a need exists for an inexpensive UHF television antenna for use by consumers who wish to view broadcast HDTV.

Like analog television tuners, ATSC digital tuners require a proper channel RF signal strength and signal-to-noise ratio (SNR) to ensure a clear, consistent picture. For analog channels, lack of or unnecessarily high signal strength, a high noise floor, or multipath signals reflected off neighboring structures results in snowy, grainy, or ghosted pictures. Most ATSC tuners require a channel signal strength of −18.5 to +15 dBmV with a minimum SNR of 15.2 dB to ensure the tuner receives the data at its maximum rate of 19.4 Mbps with a minimal Bit Error Rate (BER), so that each digital picture broadcast on the 8VSB is displayed with the best possible resolution. Preamplifiers may be used to overcome signal loss due to cable runs and splitters, which is more noticeable on UHF channels than VHF. Conventional 75-ohm input/output preamplifiers have an average noise figure (NF) of 2.9 dB or less. In addition, the noise floor at the receiver is raised depending on impedance mismatch between the signal to the receiver. Such a mismatch is expressed by the Voltage Standing Wave Ratio (VSWR), in which a value of 1 represents a perfect impedance match, and higher positive values indicate a greater mismatch. While an overall bandwidth VSWR of 1 is very desirable, a more realistic VSWR of 1.5 is considered acceptable. Therefore, for good DTV reception, a need exists for a television antenna with a low VSWR to receive a DTV channel with a sufficient SNR. In cases where all the desired digital channels are coming in from the same direction, a need exists for an antenna with an average front-to-back ratio for DTV reception of least 10 dB, since it rejects interfering signals from the sides and back.

Such an antenna would be especially useful in large urban areas where numerous reflecting structures exist; therefore a medium directional antenna is further needed as usually recommended by the CEA for optimal DTV reception in large urban areas.

Ideally, for an antenna to receive the strongest possible signal in a residential area, the antenna should be installed outdoors above the rooftop with as little obstruction toward the TV transmitter as possible. In addition, the antenna should be clear from the power lines that not only could cause electrical shock to an installer or the MATV system, but also man-made noise received by the antenna that would decrease the SNR possibly below the required level, resulting in loss of picture.

Two of the most common types of commercially available outdoor UHF antennas are a log-periodic Yagi and a bayed bowtie array in a vertical plane. Many homeowners are concerned about the physical unattractiveness of such antennas on the roofs of their homes. Such antennas are usually installed indoors. The problem with installing an antenna in the attic is that the signal received by that antenna is at least 45 to 50 percent less strong than the same signal received outdoors. This is due to signal loss through the attic wall or roof material, and if there is masonry, stone, or metal obstructing the signal, that signal is degraded even more or entirely blocked. If that signal loss sends the antenna SNR below the desired level to ensure good reception, the only sure solution is to use a physically larger conventional Yagi or bayed bowtie antenna than what is recommended for outdoor installation, and in some cases the required antenna size may not fit in the attic. Another issue for attic installation is the antenna susceptibility to receive man-made noise from electrical switches, motors, or relays installed in the attic. While man-made noise does not raise the noise floor above the noise figure of the receiver for the UHF channels, it becomes an issue for VHF channels, including low-band, where in some markets DTV is currently broadcast. On such channels, the increase in man-made noise would degrade the SNR for that channel at the antenna, resulting in a potential loss of picture on that channel. If such electrical devices are present in the attic, the likelihood of the antenna picking up the noise increases the antenna size.

Tenants of multi-unit dwellings, including condominium owners, cooperative owners, or renters, install television antennas in areas where they have exclusive use, including a balcony or patio. For this reason, such tenants are able to place Direct Broadcast Satellite (DBS) dishes on their balconies or patios. Rarely are such tenants able to install-outdoor television antennas in such areas, simply due to the size of the antenna going outside the boundaries of the areas of exclusive use.

For consumers who want to view HDTV, a need exists for an off-air antenna having good gain, front-to-back ratio, and good VSWR in the operating band, but in an area of optimal reception where the antenna can be safely installed with the fewest obstructions. Such issues become more significant for VHF reception where low-band VHF reflectors on Yagi roof mounts can be as long as 110 inches for optimal performance. In addition, VHF channels are more susceptible to man-made noise effects, so a good signal strength may be necessary on such channels in areas with many obstructions and sources of electrical noise. A need exists for a small, low-profile television reception solution that is easy to install, loosens restrictions on where to install, reject multipath effects in busy urban areas, and has good gain performance to ensure a strong SNR at the antenna.

Research has been done over the years with printed spiral and sinuous antennas for signal reception. DuHamel in U.S. Pat. No. 4,658,262, sets forth a four-element sinuous Interleaved circular antenna that showed frequency-independent characteristics and excellent broadband matching. DuHamel derived the design from frequency-independent Archamedies spiral antennas, defined by radial angles, and log-periodic antennas defined by angles, ratios, and adjacent "cells." The operating bandwidth of the design was dependent on the inner and outer radii of the elements. Such designs have been primarily used for low-profile, millimeter-wave applications in defense and radar. The DuHamel design and other applications of the design used four sinuous elements in a cross-dipole planar arrangement, and feed points for each element to allow dual circular polarization with a 90-degree hybrid feed. The antenna impedance in many applications was about 200 ohms throughout its operating bandwidth, transformed to 50 ohms with a 4:1 impedance transforming balun. In addition, the design allowed a controllable half power beamwidth throughout the frequencies of the operations, with low side and back lobe levels in the radiation patterns.

A need exists to provide a low profile antenna for television reception. To be an affordable television reception solution for consumers, such an antenna would have to be inexpensive to manufacture. While some television stations transmit their analog and digital broadcasts with circular polarization for the purposes of viewers in crowded urban and near suburban areas to receive signals with reduced multipath, acceptable reception of such signals is still possible with a linearly polarized antenna, such as the commonly used high-profile Yagi television antenna.

SUMMARY OF THE INVENTION

The present invention solves the aforesaid needs by providing a low profile television antenna capable of receiving HDTV broadcast television signals, at a low cost, with desired VSWR, SNR and front-to-back ratio values over the UHF operating band. The present invention, when turned ninety degrees, also provides acceptable reception in the VHF bandwidth.

The television antenna of the present invention is formed, in one embodiment, from a pair of generally sinuous antenna arms that extend outwardly from a common central axis and are arranged opposite each other. Each antenna arm in the pair comprises a plurality of sinuous cells with each cell having a rotational end terminating on an orientation line. The orientation lines of each antenna arm in the pair are parallel to each other and spaced apart at a first predetermined distance. The antenna arms do not interleave with each other. The output impedance of the antenna and the VSWR are affected by the first predetermined distance. A reflector is optionally provided and is supported at a second predetermined distance from the pair of antenna arms. The front-to-back ratio of the television antenna and the output impedance are affected by the second distance. Selection of the first and second predetermined distances provides a desired output impedance at the phasing stubs of the antenna of about 300 ohms over the UHF bandwidth. The reflector, in one embodiment, is a grid and the size of the grid elements control ghosting.

DETAILED DESCRIPTION OF THE INVENTION

1. Overview

Figure 1:
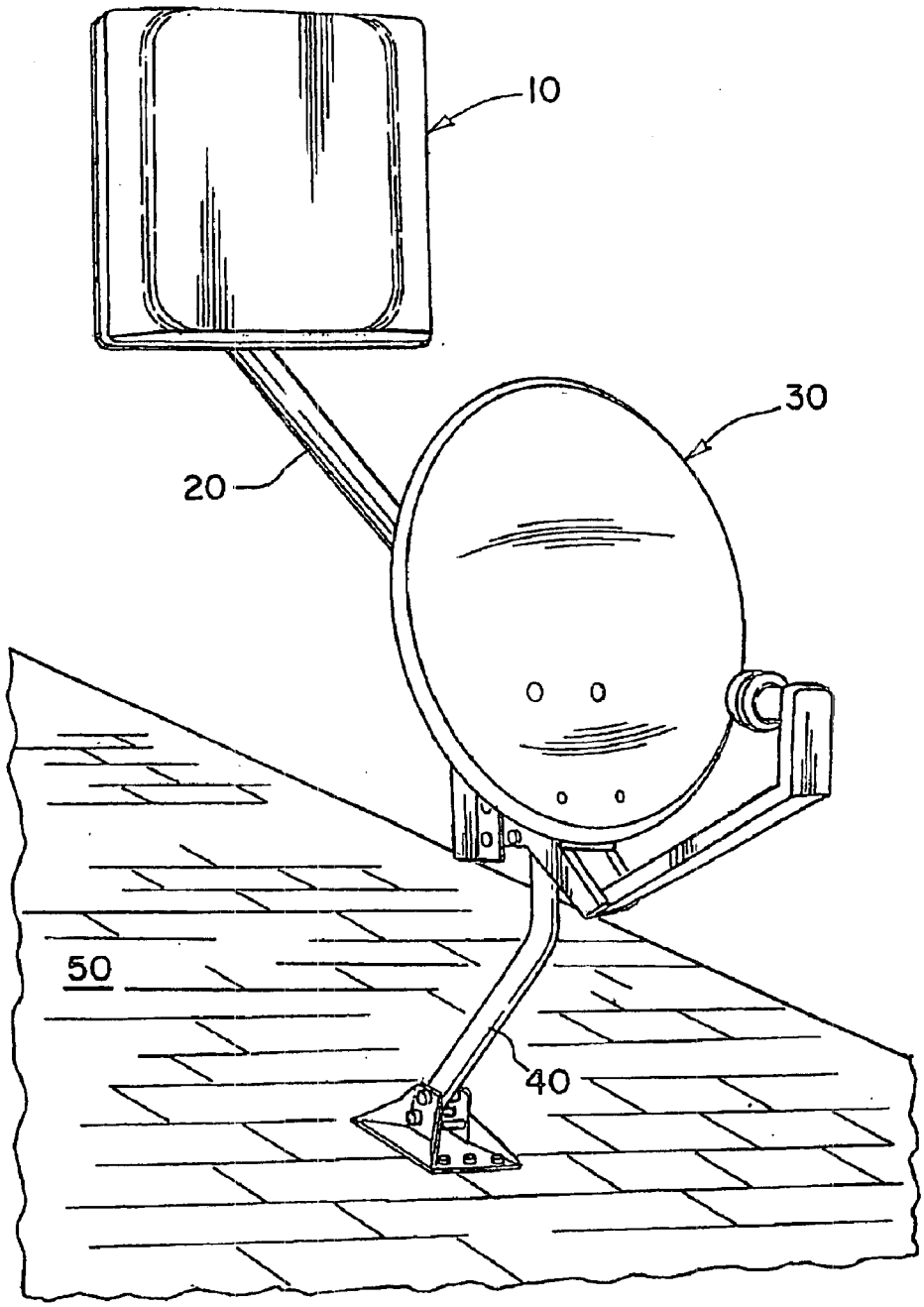
FIG. 1 is a perspective view of one embodiment showing the low profile television antenna mounted to a conventional satellite dish antenna on the roof of a residential structure.

In FIG. 1, the low profile television antenna 10 of the present invention is shown mounted by a mounting device 20 to a conventional satellite dish antenna 30. The satellite dish antenna 30 in turn is mounted conventionally 40 to the roof 50 of a house or other structure. In the embodiment shown in FIG. 1, the low profile television antenna 10 may be packaged and sold with the satellite dish antenna 30 so as to provide the user with satellite programming reception as received by dish 30 and local television broadcast signals, including HDTV signals.

The antenna 10 receives both vertical and circular polarized television signals and is resonant in the High VHF/UHF band (Channels 769).

In other embodiments, the low profile television antenna 10 of the present invention can be mounted externally to a structure such as a house, apartment, balcony, etc. It can also be used internally such as under a roof, on an overhead rafter, on a deck rail, or on a standalone support in a room. It can also be mounted outside a structure such as on a pole. Finally, the low profile television antenna 10 can be mounted on a vehicle such as a recreational vehicle or on a boat in the marine environment.

The use of the low profile television antenna 10, under the teachings of the present invention, is vigorous and can be utilized in any suitable environment with any suitable mounting device 20.

2. Low Profile Television Antenna Housing Details

Figure 2:
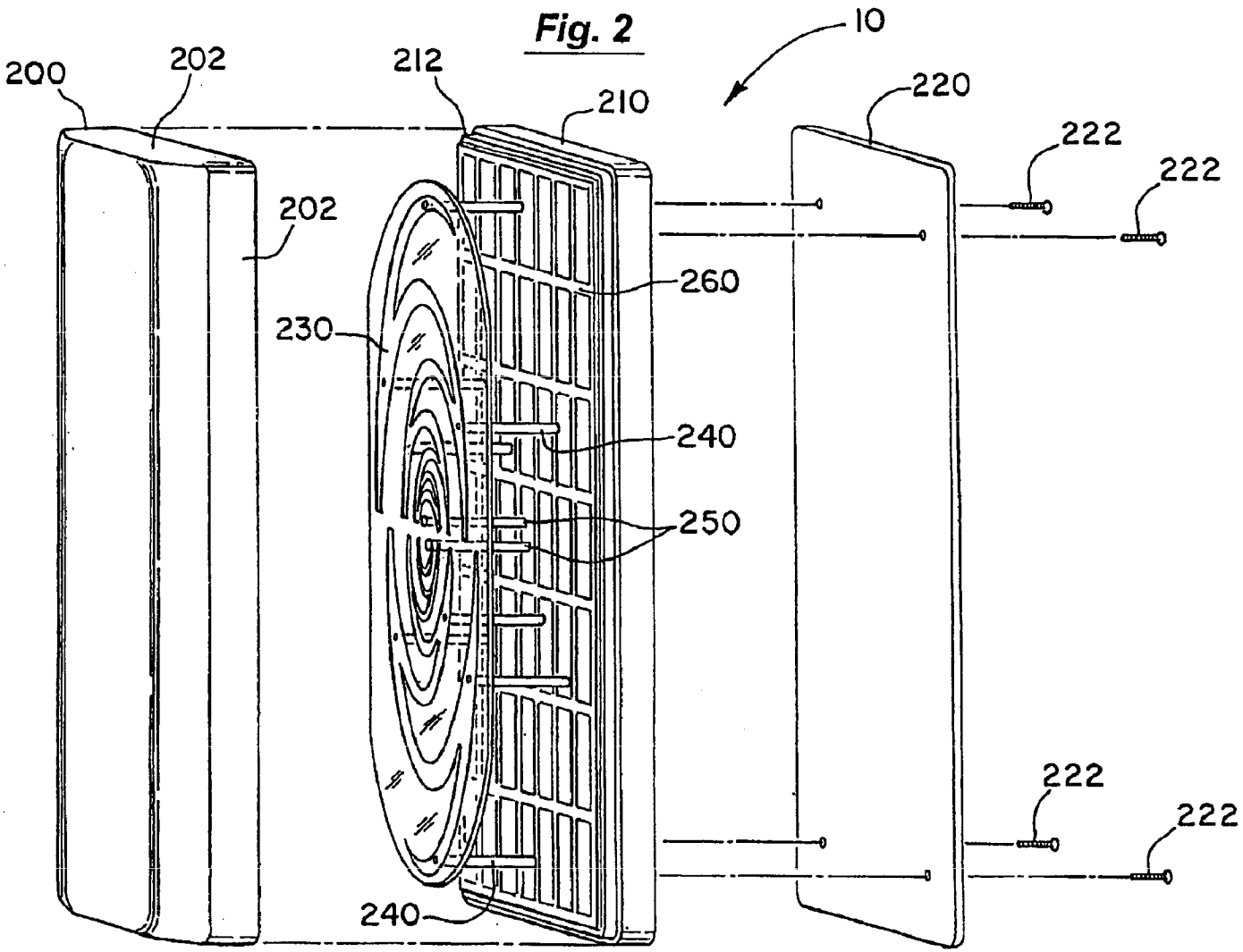
FIG. 2 sets forth an exploded perspective view of the low profile television antenna of FIG. 1.

In FIG. 2, the low profile television antenna 10 of the present invention is shown to include a front housing cover 200, a back chassis 210 and a rear housing cover 220. In one embodiment four screws 222 are utilized to mount the rear housing cover 220 to the chassis 210. Each screw 222 engages a corresponding formed hole to firmly hold the rear cover 220 to the chassis 210 when the screws 222 are inserted. It is to be expressly understood that any suitable means for attaching the rear cover 220 to the chassis 210 can be utilized under the teachings of the present invention. The front cover 200 is designed to have its sides 202 snap over and firmly engage a formed channel 212 in the chassis 210. Again, any suitable means for engaging the front cover 200 to the chassis 210 could be utilized under the teachings of the present invention. Indeed, any conventional housing or packaging for the front cover 200, the chassis 210 and the rear cover 220 could be utilized without departing from the spirit of the present invention. The material used in the front cover 200, the rear cover 220 and the chassis 210 is preferably made from a suitable ABS plastic. This material used is designed not to interfere with the reception of the antenna 10 of the present invention.

In other embodiments, the cover 200 and/or the back cover 220 are not used.

It is to be understood that the housing design set forth above is but one of many different housing designs that could be used under the teachings contained herein. For outside use, conventional weather-proofing designs can be used. For indoor use, the housing can be minimal (or nonexistent) and can be made more aesthetically pleasing such as with lights, etc.

3. Antenna Construction

As shown in FIG. 2, an antenna 230 is shown mounted to the chassis 210 by a plurality of support posts 240. Matching stubs 250 are used to connect the antenna 230 to a 4:1 conventional balun (not shown in FIG. 2). Also shown in FIG. 2 is a reflector 260 mounted to chassis 210.

Figure 3:
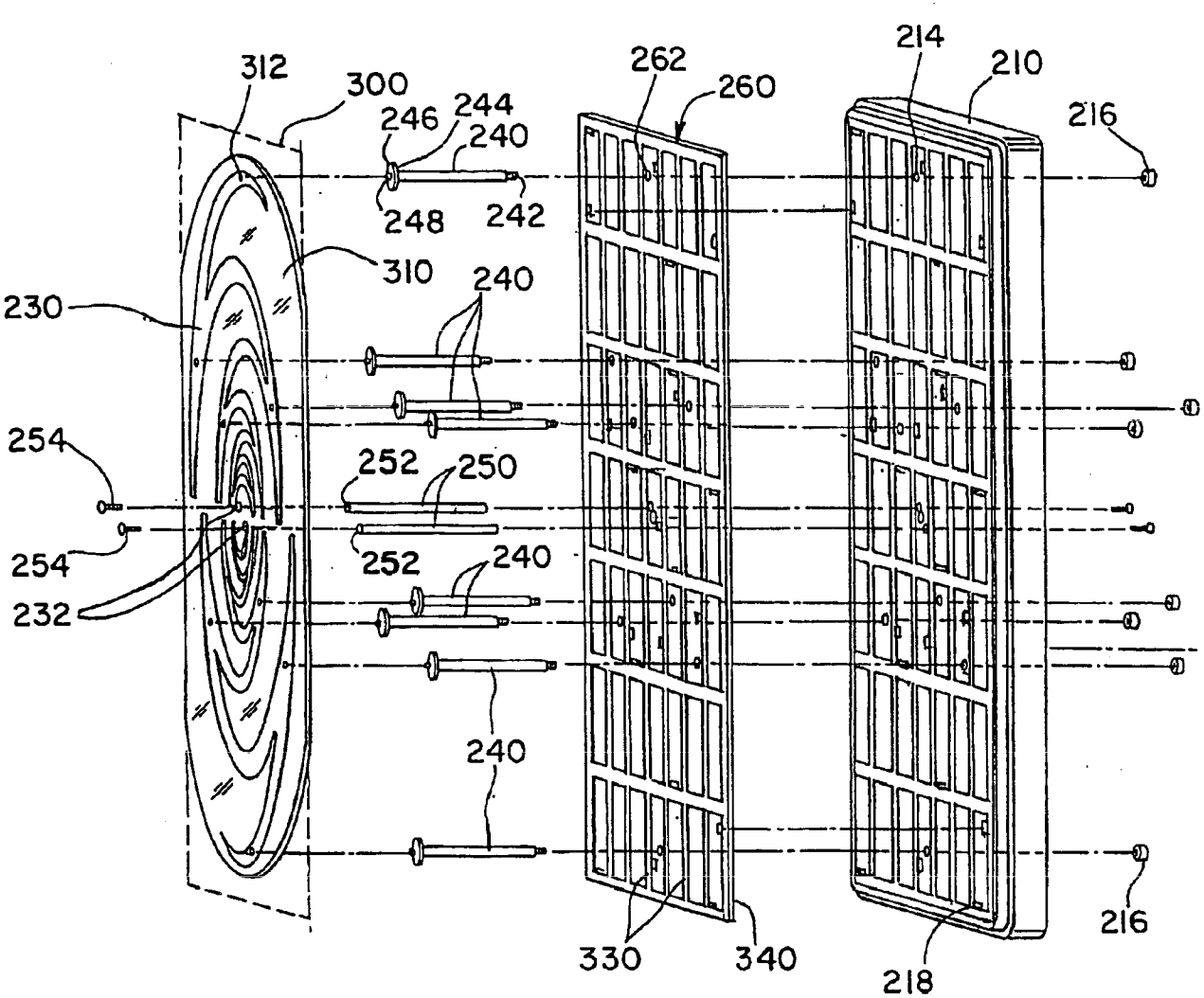
FIG. 3 sets forth an exploded perspective view of the sinuous antenna of the present invention of FIG. 2.

As shown in FIG. 3, the antenna 230, in one embodiment, is oriented in a geometric shape 300. The antenna 230 can be formed of metallic material such as aluminum (or any other suitable conductive metal). Or in the embodiment shown in FIG. 3, the antenna 230 is formed on a sheet 310 oriented in geometric plane 300. In this embodiment, the antenna 230 can be printed onto a plastic sheet 310 made from acrylic, polycarbonate, fiberglass, or any suitable material that has a high dielectric constant. In one embodiment, conductive silver ink is printed on the sheet 310 in the shape of the antenna 230. An example of a commercially conductive silver ink is ACNESON No. 725A from Acheson Colloids Co., 1600 Washington Avenue, Park Huron, Mich. 48060. It is to be understood that any suitable conductive material other than silver ink could be utilized under the teachings of the present invention.

In the embodiment of FIG. 3, eight support posts 240 are used to hold the antenna 230 a pre-determined distance (see distance 700 in FIG. 7) from the reflector 260. Each support post 240 has a threaded end 242 and an enlarged end 244 having an adhesive surface 246 and an extending nub 248. The threaded end 242 is inserted through a corresponding hole 262 in reflector 260 and in hole 214 in chassis 210 so as to threadedly engage a nut 216. This firmly holds the support posts 260 to the chassis 210. The nub 248 seats in a formed hole 312 in the sheet 310. The adhesive 246 on head 244 adheres to the underside of sheet 310 so as to firmly hold sheet 310 to the support post 240. The support posts 240 are also made of high dielectric plastic material such as ABS plastic. At least one support post 240 is used, but any of a number of different structural designs could be utilized to support the antenna 230 to the chassis 210. The present invention is not to be limited by the design of the specific support structure shown in FIG. 3 by individual support posts 240.

Also shown in FIG. 3 are the two matching line stubs 250 which are made of conductive material such as aluminum. The matching line stubs 250 have formed holes 252 at one end to receive metallic, conductive screws 254. In the antenna 230, each terminal feed point 232 has formed holes which receive the screws 254. In the preferred embodiment, the antenna 230 is printed on the underside (i.e., the side facing the reflector 260) of the sheet 310 so that the conductive silver ink abuts against the end 252 of the stubs 250 when the screws 254 are firmly inserted. This assures a solid electrical connection between the stubs 250 and the antenna 230.

Figure 10:
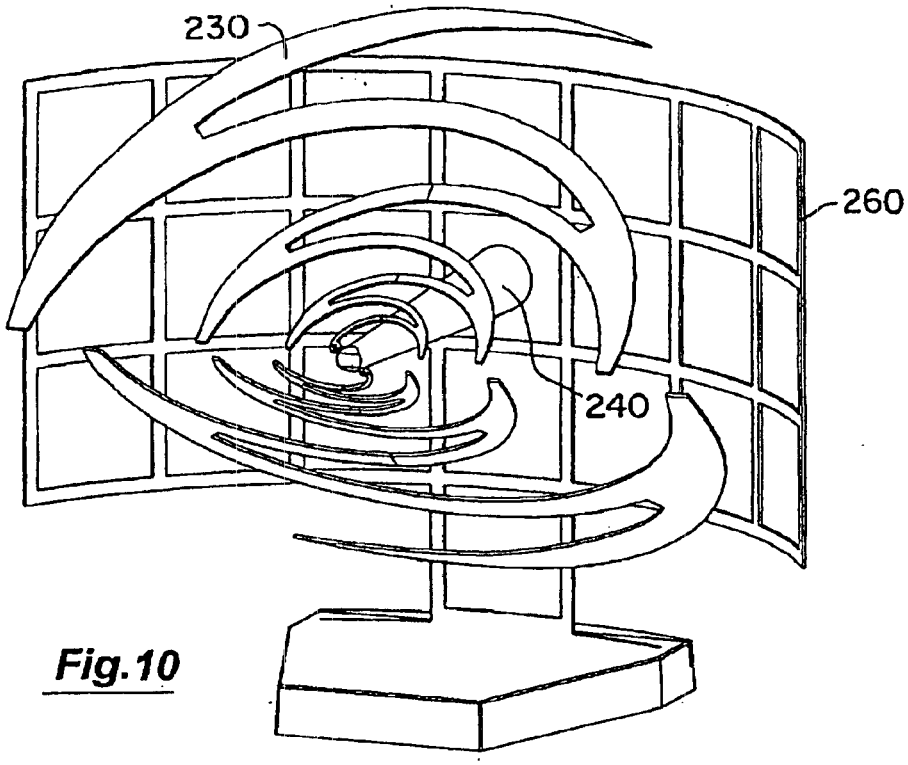
FIG. 10 sets forth an alternate embodiment of a low profile television antenna of the present invention.
Figure 11:
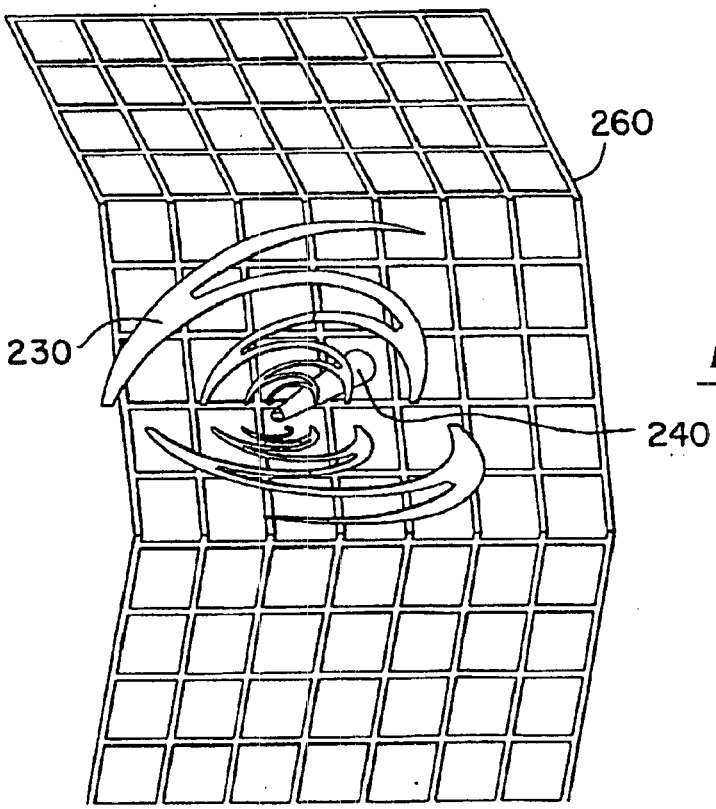
FIG. 11 sets forth an alternate embodiment of the low profile antenna of the present invention.
Figure 12:
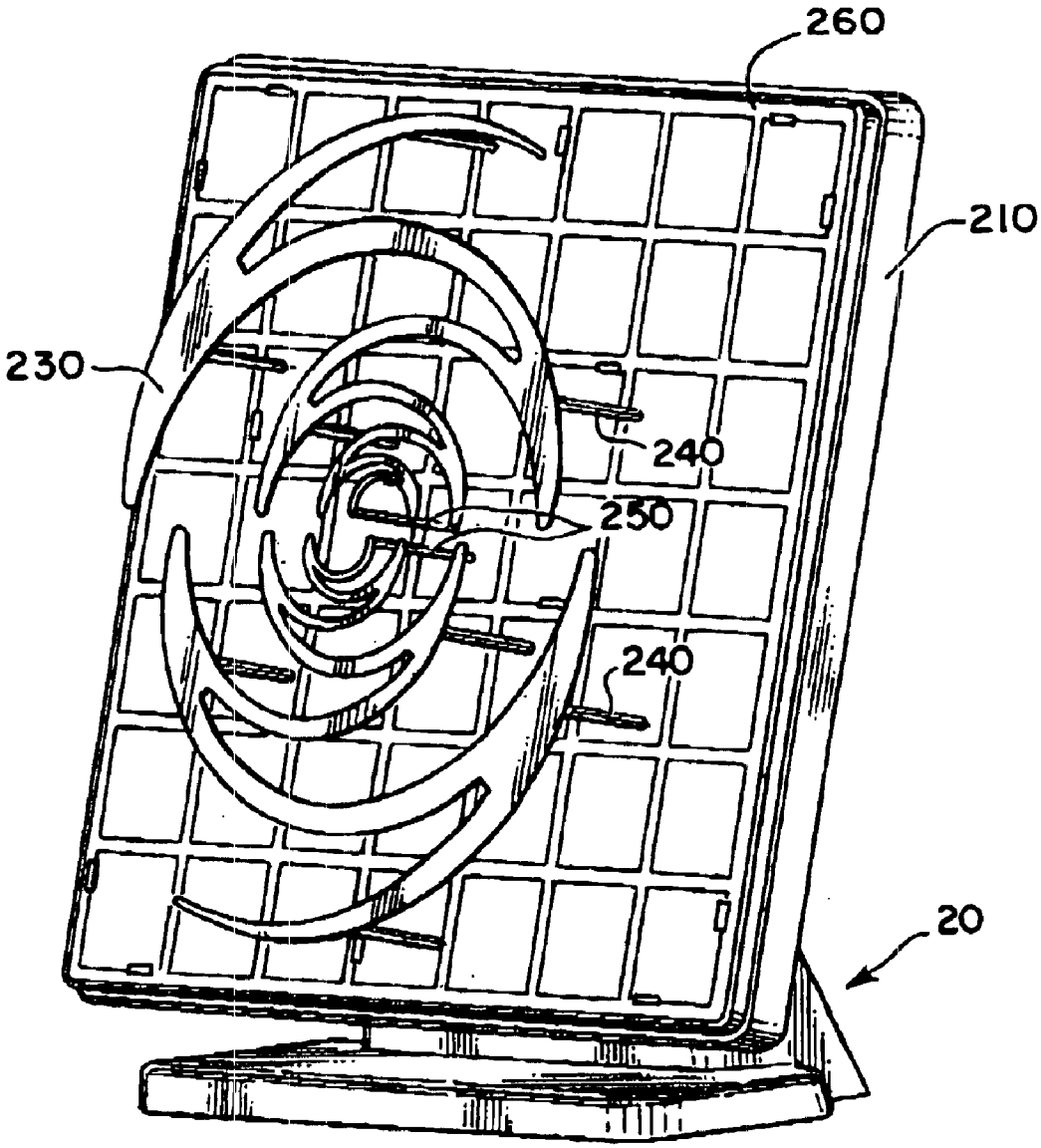
FIG. 12 sets forth an alternate embodiment of the low profile antenna of the present invention.

FIGS. 2 and 3 show one embodiment of the antenna of the present invention. Examples of three additional embodiments are shown in FIGS. 10, 11 and 12 and are discussed later. The teachings contained herein are not limited to these four embodiments. Any suitable antenna design based on such teachings are covered.

In FIG. 3, the geometric plane is shown to be planar. The antenna 230 can be formed of metallic material (such as shown in FIG. 10) or can be deposited on a sheet 310 (such is shown in FIG. 3). However, the geometric plane can be any desired shape. For example, in FIGS. 10 and 11 the geometric plane is wedge-shaped and the antenna is formed in the wedge shape. The geometric shape 300 can be a plane, wedge, a cylinder, or any other shape incorporated in the teachings of the present invention.

4. Reflector Design

Figure 5:
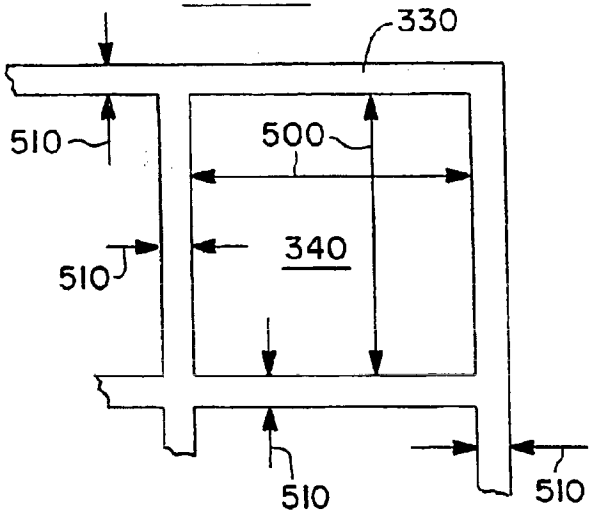
FIG. 5 sets forth the details of a grid in the reflector of FIG. 4.
Figure 4:
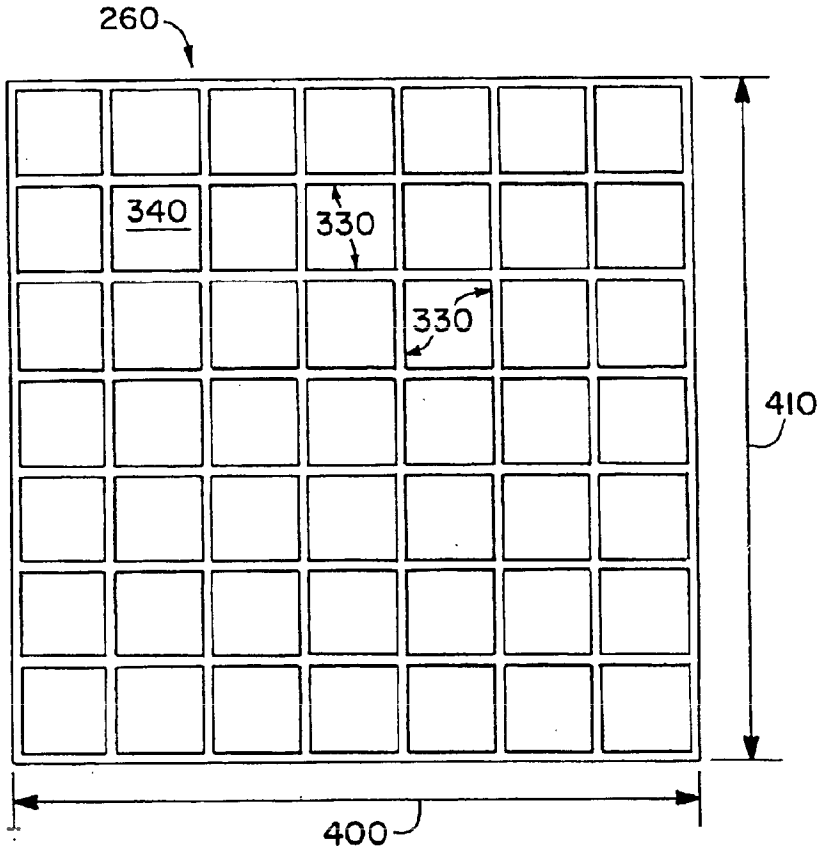
FIG. 4 sets forth a front planar view of the reflector of the present invention.

The reflector 260 is composed of a sheet of plastic material such as surface 310 and is also, in the embodiment of FIG. 3, planar. Conductive silver ink 330 is shown printed on the sheet 340 in a square grid pattern as shown in FIGS. 4 and 5. In FIG. 4, the dimensions of one embodiment of the grid is 400 by 410 where 400 equals 15 inches and 410 equals 15 inches. This is but one embodiment and any suitable size could be configured under the current teachings herein.

In FIG. 5, the grid 330 has an internal square dimension of 500 which equals, in one embodiment, 1.9 inches with the thickness 510 of the printed element 330 equal to 0.213 inches. The cell sizes 500 are dimensioned for antenna performance, manufacturability, and appearance. Further, when based on odd dimensions of a wavelength, the reflector 260 is more effective in the rejection of unwanted multipath signals.

It is to be expressly understood that the grid 330 could be any geometric shape, including rectangular, circular, etc. It is also to be expressly understood that the reflector 260 could be of solid conductive material, such as thin aluminum, aluminum foil, or any other suitable conductive material. It is also to be expressly understood that the metallic grid 330 can be printed or deposited directly on surface 218 of the chassis 210 thereby eliminating the use of a separate sheet of material 340. This would simplify the design of a low profile television antenna 10 of the present invention and reduce its costs. FIG. 3 for simplicity shows the two embodiments of the reflector 260 to be either deposited on sheet 340 or deposited directly on surface 218.

Figure 7:
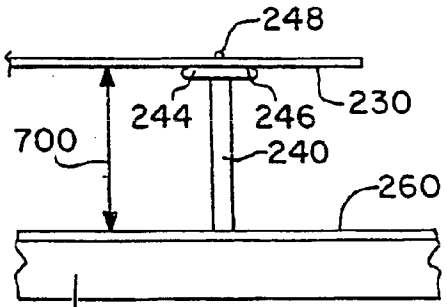
FIG. 7 sets forth a side planar view of one support post of the present invention.

In FIG. 7, the antenna 230 is spaced a distance 700 from the reflector 260. In the embodiment shown in FIG. 6, this spacing is about 2 inches. A spacing of about 4 to 4½ inches would provide more optimum performance of the antenna. A spacing of about 2 inches is used to trade performance off for a low profile, less bulky (and more inexpensive) antenna 10. Adjusting the spacing 700 affects the front-to-back ratio and the output impedance. The reflector 260 also contributes to low-end cutoff, the amount of band pass below 470 MHz, the forward directivity of the antenna 10, gain, and overall performance. The selection of the amount for distance 700 is also used to determine front-to-back forward gain and rejection of multipath signals.

The reflector 260 also makes the antenna 10 unidirectional and prevents the antenna 10 from receiving television signals aimed from behind the reflector 260 towards the antenna pair 230. In some embodiments of the present invention, the use of a reflector plane 260 is not utilized.

5. Sinuous Antenna/Reflector Control Distances and Results

Figure 6:
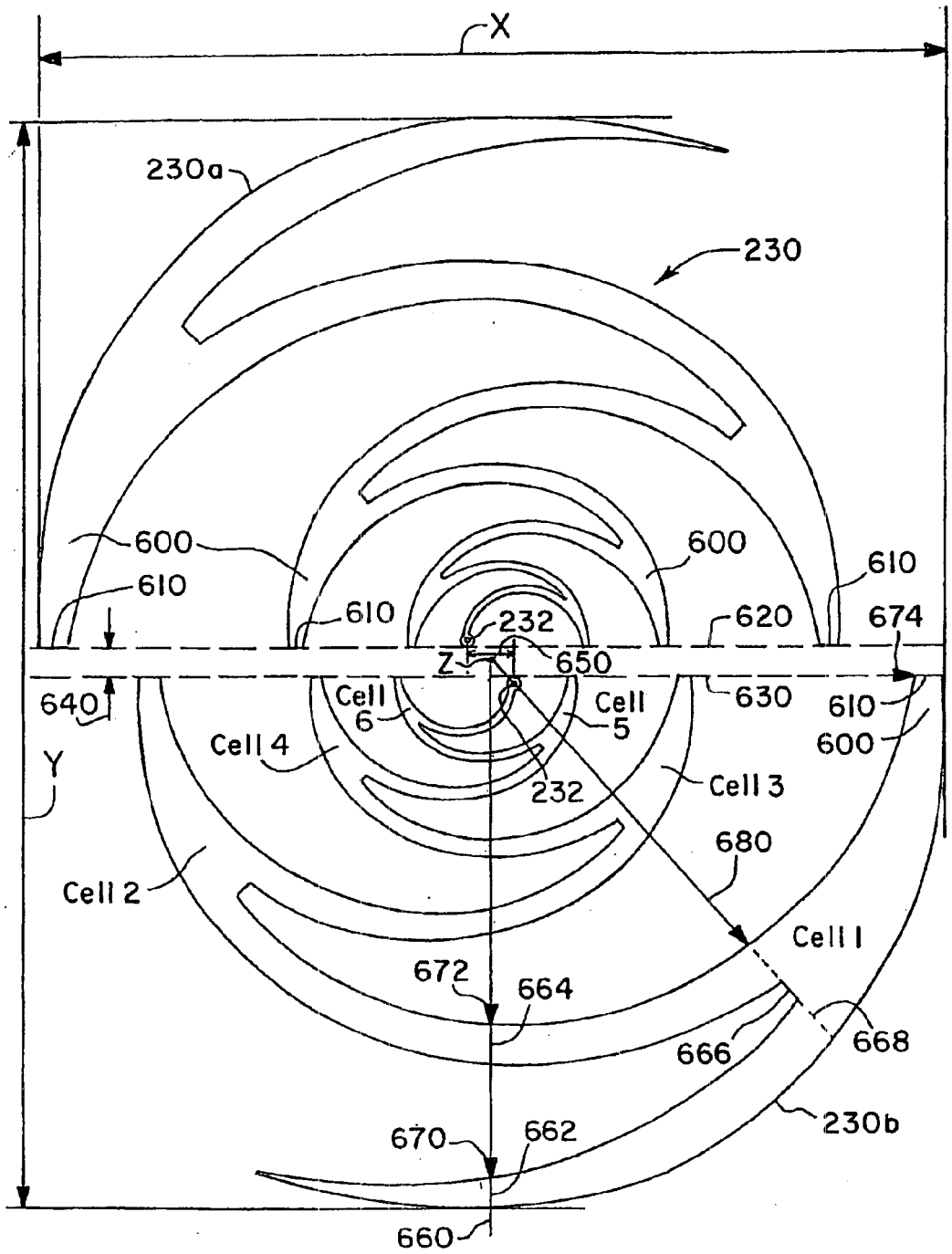
FIG. 6 sets forth a front planar view of the sinuous antenna arms of the present invention.

In FIG. 6, the details of one embodiment based on a sinuous design of the antenna 10 is set forth. In the embodiment shown in FIG. 6, a sinuous antenna 230 is formed from two identical sinuous antenna arms 230*a* and 230*b*. In FIG. 6, the arms 230*a* and 230*b* are identical in shape, but it is understood that a workable antenna 10 could be designed wherein arms 230*a* and 230*b* are not substantially identical in which case performance degrades. Each arm 230*a*, 230*b* is generally sinuous in design and it is to be understood that the "generally sinuous" design of each arm 230*a*, 230*b* can vary as is known in the art as, for example, based on a log-periodic or a quasi-log-periodic design. The arms 230*a*, 230*b* extend outwardly from a common central axial axis Z and are arranged opposite each other. As shown in FIG. 6, the antenna arms 230*a*, 230*b* are formed without interleaving each other and without touching each other. As such, the antenna of the present invention is not self-complementary. Furthermore, the antenna 230 is directional as its performance varies as it is rotated about the Z axis.

In FIG. 6, the size of the antenna 230 in the Y direction is 13.712 inches and in the X direction is 11.097 inches. This provides an oblong (or rectangular) shape to the antenna and the vertical orientation for UHF reception is shown in FIG. 6. The oblong shape causes the antenna 230 to exhibit bi-directional performance.

As shown, each arm 230*a*, 230*b* has six sinuous cells (Cell 1 through Cell 6). More than six cells would result in better antenna performance (i.e., gain, directivity, front-to-back ratio, and VSWR). A lower number of cells results in less antenna performance.

The oblong embodiment shown in FIG. 6 and the dimensions given above, provide an acceptable consumer compromise for antenna size versus antenna performance. Each cell has at its midpoint a tooth 600. These teeth 600 terminate in a rotation end 610. In this embodiment, the rotation end 610 is tapered. In other embodiments, the end 610 is not tapered. As shown in FIG. 6, for arm 230*a*, the six ends align along an orientation line 620. Ends 610 are nulls and each end 610 could be optionally conductively connected to the reflector 260 without affecting performance. The reflector 260 in one embodiment is grounded (such as to a metal support pole) and in another embodiment is not grounded.

Likewise, for arm 230*b*, the ends 610 align on an orientation line 630. The orientation lines 620, 630 of the two antenna arms 230*a*, 230*b* are spaced from each other at a pre-determined distance 640 and the embodiment of FIG. 6 is 0.250 inches. The value of the distance 640 affects output impedance and the VSWR. The closer the lines 620 and 630 are, the lower the output impedance of the antenna 230. The antenna shown in FIG. 6 with a spacing of 0.250 inches results in an impedance of 300 ohms over the UHF bandwidth.

FIG. 6 shows a pair of generally sinuous antenna arms 230*a* and 230*b* extending outwardly from a common central axis Z and arranged opposite each other. Each antenna arm 230*a*, 230*b* is formed from a plurality of sinuous cells (Cell 1 through Cell 6). Each of the cells has an end 610 terminating on an orientation line 620, 630. The orientation lines 620, 630 are spaced a predetermined distance apart 640 in a parallel relationship to each other as shown in FIG. 6. As witnessed in FIG. 6, each of the antenna arms 230*a* and 230*b* are formed without interleaving or touching the other antenna arm. This forms an oblong or rectangular shape as shown in FIG. 6 where Y is greater than X. FIG. 6 shows the vertical orientation which is the preferable embodiment for UHF television reception.

In the vertical orientation in FIG. 6, the sinuous antenna 230 receives UHF signals and if the antenna of FIG. 6 were reoriented by 90° (placing Y in the X direction and X in the Y direction), the antenna exhibits better performance in the VHF and FM frequency range. It has been observed that at a given reception site, orienting the antenna at an angle in the X–Y axis may permit acceptable reception of both the VHF and UHF frequency ranges. Each such physical site is specific. However, the antenna 10 in the vertical orientation of FIG. 6 receives the UHF bandwidth as discussed later.

The actual measurements for the embodiment shown in FIG. 6 are:

| | Distance (inches) | | | | | | | | |
|---|---|---|---|---|---|---|---|---|---|
| Cell | 670 | 662 | 672 | 664 | 680 | 666 | 668 | 674 | 680 |
| 1 | 6.45 | .330 | 4.43 | .490 | 4.88 | .310 | .633 | 4.43 | .350 |
| 2 | — | — | 3.02 | .330 | 4.40 | .240 | .441 | 3.03 | .240 |
| 3 | — | — | 2.09 | .231 | 3.34 | .146 | .298 | 2.09 | .160 |
| 4 | — | — | 1.43 | .155 | 2.299 | .113 | .208 | 1.430 | .110 |
| 5 | — | — | .980 | .109 | 1.573 | .069 | .141 | .990 | .080 |
| 6 | — | — | .670 | .074 | .746 | .054 | .098 | .680 | .050 |

It is to be expressly understood, that the above values are for a specific design and that other values and cell shapes could be used to implement the teachings of the present invention. Each arm 230*a*, 230*b* in the pair 230 should be identical in shape or may vary slightly in shape. While a sinuous design is shown, the antenna arms could be spiral or zig-zag and still achieve antenna performance in the UHF band.

In the table above, two identical antenna elements are provided for the antenna of FIG. 6. The antenna arms in other embodiments should be identical. However, in the above table with reference to FIG. 6, a UHF television antenna 10 is set forth having two identical sinuous antenna arms 230*a*, 230*b* located opposite each other on an axial axis Z and separated from each other by a first predetermined distance 640 for receiving broadcast UHF television signals. The radiation patterns are set forth next for this embodiment. A pair of phasing stubs 250 are connected to feed points 232 of the antenna arms 230*a*, 230*b*. Reflector 260 is oriented a second predetermined distance 700 from the two antenna arms, 230*a* and 230*b*. The first and second predetermined distances are values that provide a desired output impedance at the phasing stubs 232 of about 300 ohms for the UHF bandwidth.

Figure 8:
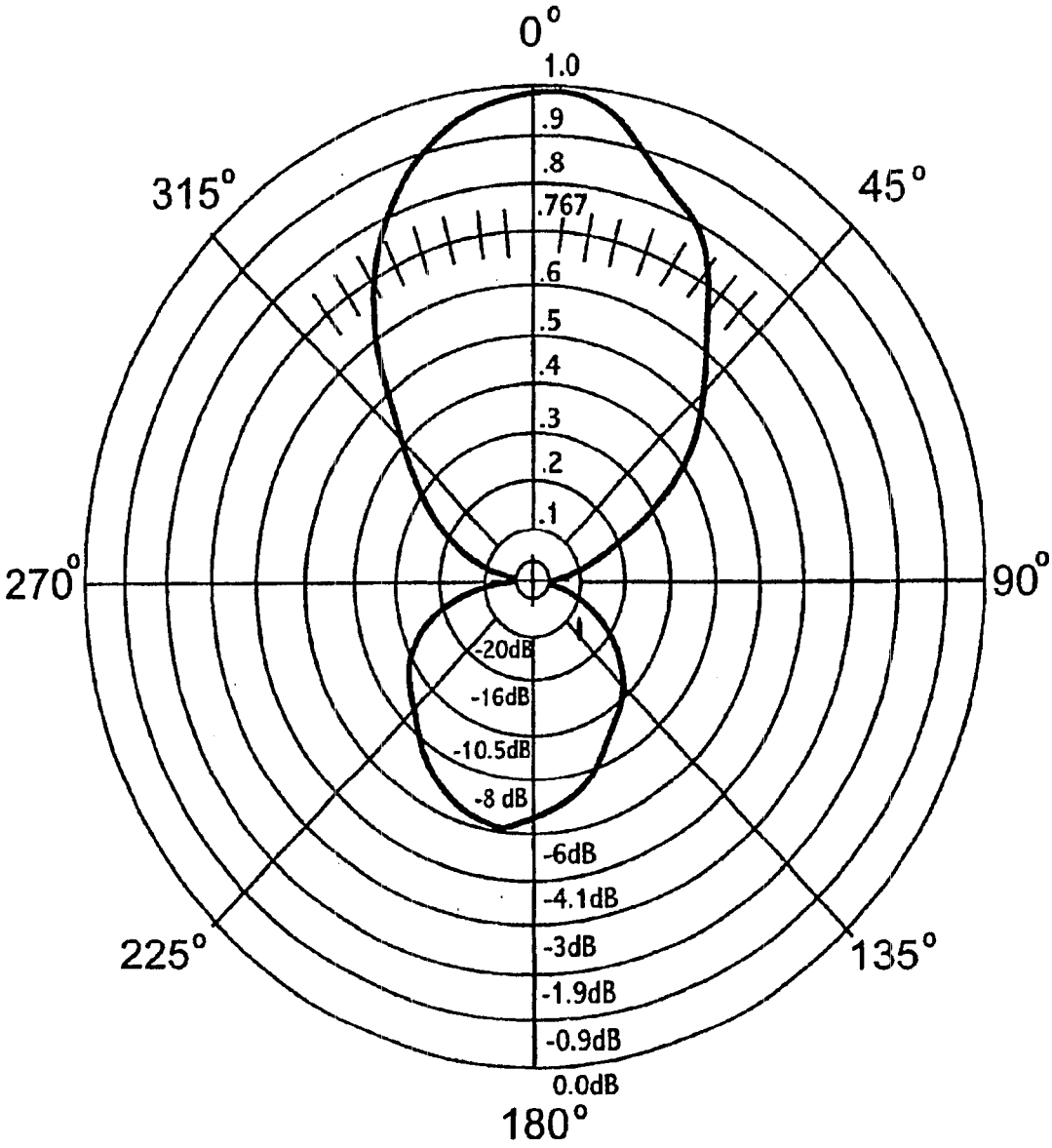
FIG. 8 sets forth a radiation pattern for UHF channel 14 for the antenna of FIG. 6.
Figure 9:
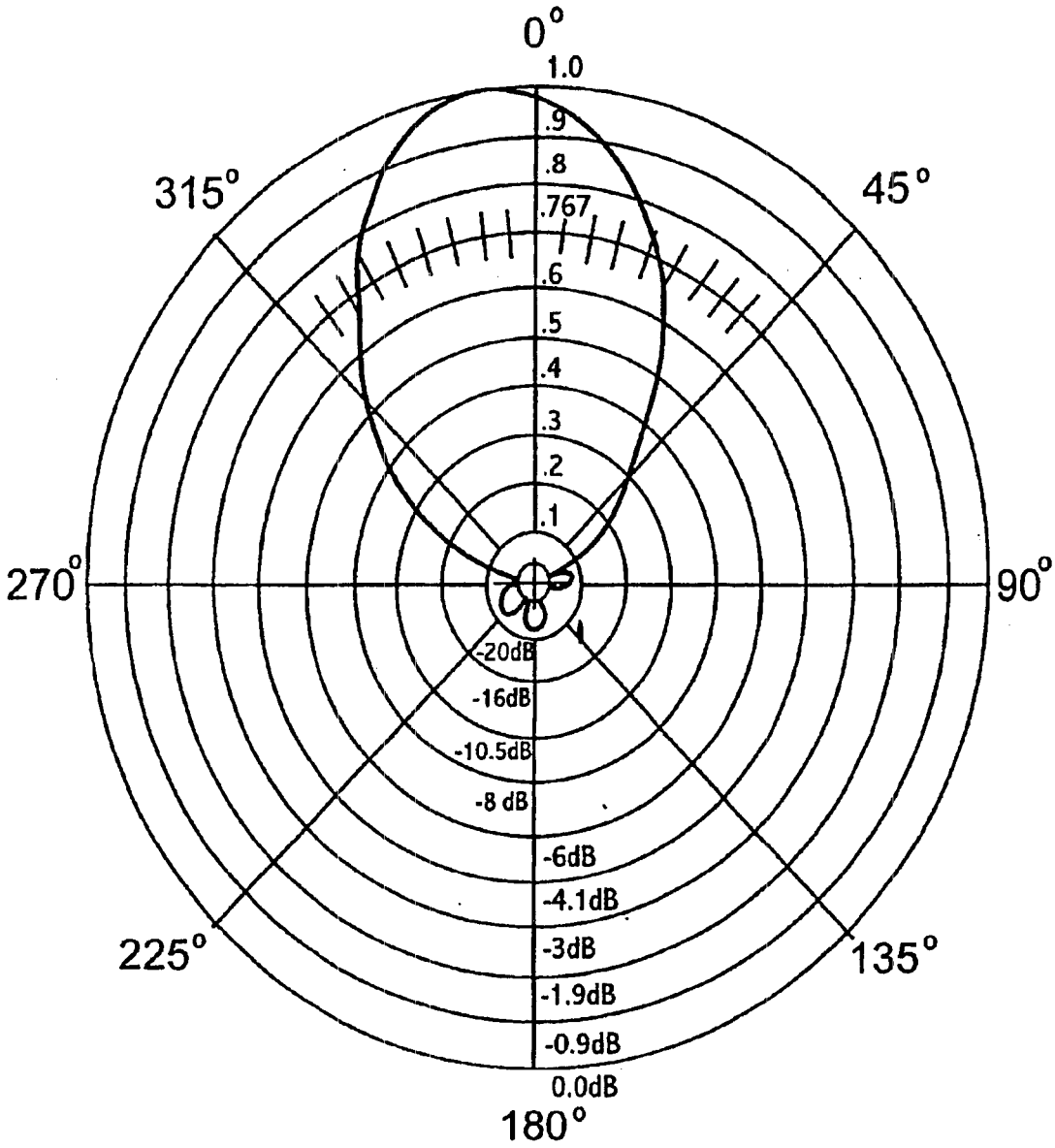
FIG. 9 sets forth the radiation pattern for UHF channel 69 for the antenna of FIG. 6.

FIG. 8 sets forth the radiation pattern for the antenna of FIG. 6 oriented, as shown, in the vertical position for channel 14 (471.25 MHz). FIG. 9 sets forth the radiation pattern for channel 69 (805.75 MHz). These two radiation patterns are chosen for channels at the opposite ends of the UHF spectrum. The data shown in FIGS. 8 and 9 are from tests performed on an outdoor range following IEEE Standard 149-1979. For the tests, the range conditions were: long, moist grass. The weather conditions were: clear, light wind, 70°. In FIG. 8, the front-to-back ratio is 6.3 dB and in FIG. 9, it is 21.8 dB. These ratios provide solid reception for typical consumer use. The Half Power Beam Width (HPBW) for FIG. 8 is 68 degrees and for FIG. 9 is 52 degrees. A pipe-foot mount was used to mount the antenna. The lower the value of HPBW, the more directive the antenna is. A higher front/back (FIB) ratio provides better rejection.

Some television stations transmit their analog and digital broadcasts with circular polarization for the purposes of viewers in crowded urban and near suburban areas to receive signals with reduced multipath. The cells in antenna 230 are sized to resonate in the UHF and VHF bands. By using a 4:1 impedance transforming conventional balun with the 300 ohm antenna of the present invention, the output impedance is 75 ohms, the standard impedance for MATV systems. Dimensions 640 and 650 affect the output impedance and VSWR of the antenna 10 which are two factors in the efficient transfer of signal to the transmission lines 250.

Figure 13:
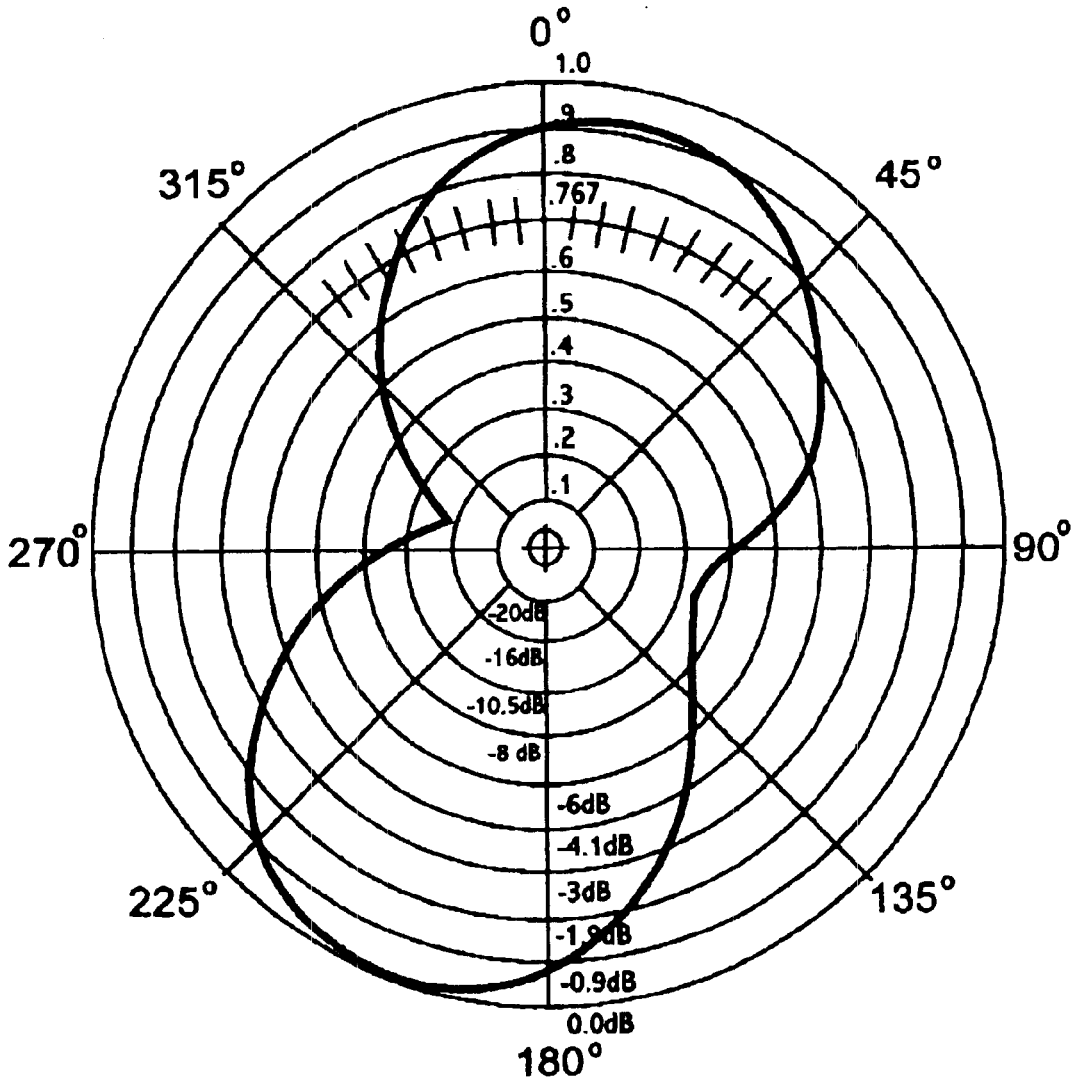
FIG. 13 sets forth the radiation pattern for VHF channel 7 for the antenna in FIG. 6 in horizontal orientation.

It has been determined that the arrangement of two sinuous arms 230*a*, 230*b* formed oblong in a vertical plane orientation demonstrate pattern characteristics and impedance of a common dipole, only with a broader band due to the angular nature of the cells. Another observation of the two arm 230*a*, 230*b* configuration is that the linear separation 640 between arms 230*a*, 230*b* determines band response given the planar orientation of the arms. It has been observed that a VHF response is possible with the arms 230*a*, 230*b* arranged either vertically or horizontally. In FIG. 13, the radiation pattern for VHF Channel 7 (175.25 MHz) is shown. The HPBW is 83 and the front-to-back ratio of −0.7 dB. The antenna of FIG. 6 was tested according to IEEE Standard 149-1979 and the weather was partly sunny, low wind, 85–90° F. The antenna of FIG. 6 was oriented in a horizontal position to obtain the pattern of FIG. 13 and this pattern provided improved VHF gain performance over the vertical position for the same channel.

Pattern testing of the design in FIG. 6 with the addition of a reflector 260 showed this design to have a directive beam width with minimal side lobe levels and a front-to-back ratio of 10 dB or greater. The grid spacing 500 and separation 700 between the grid 260 and the sinuous arms 230*a*, 230*b* also affect the low-end cutoff in the operating bandwidth response.

The teachings herein provide a low profile UHF antenna about 15 inches by 15 inches in surface area, and about two inches in depth, about the size of a 46 cm DBS home satellite television dish. By adding phasing stubs 250 at the feed points 232 and a conventional surface-mount impedance balun (not shown), the design provides a 75-ohm VSWR of 1.35 or better in the UHF band, and an average UHF gain of about 5 dB.

In summary, for the antenna discussed above, the following were obtained across the UHF band:

| | |
|---|---|
| Average beamwidth | 61° |
| Average VSWR | 1.3:1 |
| Average Front-to-Back Ratio | 13 dB |
| Average Gain | 4.5 dB |
| Housing Size | 15.8" × 15.8" × 3.4" |

In addition to an outdoor application, this design may be adapted into an indoor antenna design (FIG. 12) that can be placed in a convenient location where signal can penetrate through building material with the least possible loss, such as a ledge facing a window out toward the television transmitters. The uniqueness of the sinuous arms 230*a*, 230*b* also promotes an attractive and trendy design to complement the new HDTV monitors. Rejection of extraneous multipath signal makes this design useful for urban dwellers in apartments and condominiums, and a built-in amplifier at the surface mount impedance transforming balun makes the antenna 230 active in cases where additional signal strength is needed, depending on the signal at the antenna and length of cable run to the receiver.

The back plane and size of the antenna allows a foot-and-pipe mount to be placed on the antenna, allowing the freedom to install the antenna outdoors on balconies, patios, roofs, and walls, away from power lines and electrical noise sources in open areas. The design also allows the installation of a low-noise preamplifier to overcome UHF signal loss in the downlead to the receiver. The antenna can be packaged into a snap-fit mold that the consumer may paint to mask it with the house, providing a functional but attractive television reception solution useful in suburban areas.

6. Alternate Embodiments

In FIGS. 10, 11 and 12 are three of many possible alternate embodiments of the present invention.

In FIG. 10, the sinuous antenna 230 has its arms 230 formed into a wedge shape with the open end of the wedge shape facing the reflector 260. The reflector 260 is in circular shape with the inside of said curved shape facing the open end of the antenna 230. The antenna 10 is supported conventionally by a base 20. And the antenna arms are supported by a support 240. In FIG. 10, the arms 230*a*, 230*b* are formed from conductive metals such as aluminum and the reflector 260 is also cut from aluminum. In this embodiment, there is no housing over the antenna 230 or the reflector 260, nor is the antenna 230 or the reflector 260 using a dielectric sheet.

In FIG. 11, another alternate embodiment is shown. Here the antenna 230 is similar in design to the antenna of FIG. 10 forming a wedge shape. The reflector 260 however, rather than being curved as shown in FIG. 10 has ends 260*a* and 260*b* folded in a direction towards the antenna 230.

In FIG. 3, an indoor embodiment of the antenna 10 shown in FIGS. 2 and 3 is illustrated.

A large number of other embodiments all of which are compact under the teachings of the present invention can be utilized to incorporate the teachings contained herein. For example, simply using the antenna 230 printed on a polycarbonate sheet 310 without use of a reflector 260 or a chassis (and corresponding cover) could be mounted to a window (such as in a high rise apartment complex) and the stubs 250 delivered into a balun. In another embodiment, the two antenna arms 230*a*, 230*b* could be oriented parallel to each other. Any suitable geometric configuration can be utilized with respect to arms 230*a*, 230*b*. Each arm could be constructed separately of metal, metal foil, wire deposited or printed on a sheet, etc.

The above disclosure sets forth a number of embodiments of the present invention. Those skilled in this art will however appreciate that other arrangements or embodiments, not precisely set forth, could be practiced under the teachings of the present invention.

I claim:

1. A television antenna comprising:

a pair of generally sinuous antenna arms extending outwardly from a common central axis and arranged opposite each other, each antenna arm in said pair comprising a plurality of sinuous cells, each of said plurality of cells having a rotational end terminating on an orientation line, said orientation lines of said pair of antenna arms spaced a predetermined distance apart in a parallel relationship to each other, each said antenna arm being formed without interleaving the other said antenna arm.

2. The television antenna of claim 1 wherein said pair of sinuous antenna arms are formed in clockwise rotation.

3. The television antenna of claim 1 wherein said pair of generally sinuous antenna arms are formed in a plane, said plane perpendicular to said common central axis.

4. The television antenna of claim 3 wherein said plane is a sheet of dialectric material and said pair of generally sinuous antenna arms are printed from metal-based conductive ink on said sheet.

5. The television antenna of claim 3 wherein the output impedance of the television antenna is a function of the predetermined distance.

6. The television antenna of claim 3 wherein said pair of generally sinuous antenna arms are formed from metallic material in said plane.

7. The television antenna of claim 1 further comprising:

a reflector plane, at least one support connected to said reflector plane and to said pair of generally sinuous antenna arms, said at least one support providing a separation distance between said reflector plane and said pair of generally sinuous antenna arms, the front-to-back ratio of said television antenna at least a function of said separation distance.

8. The television antenna of claim 7 wherein said separation distance is less than a separation distance providing optimal front-to-back ratio so that said television antenna is low-profile.

9. The television antenna of claim 7 where the reflector plane is a grid of square reflector elements of conductive metal material, the dimensions of each said reflector elements at least being an odd percentage of a wavelength of an undesired signal so as to reject said undesired signal.

10. The television antenna of claim 9 wherein the conductive metal material is conductive ink.

11. The television antenna of claim 1 wherein each antenna arm in said pair has the identical shape.

12. A television antenna comprising:

a pair of generally sinuous antenna arms extending outwardly from a common central axis and arranged opposite each other, each antenna arm comprising a plurality of sinuous cells, each of said plurality of cells having a tapered rotational end terminating on an orientation line, said orientation lines of said two antenna arms spaced at a predetermined distance in a parallel relationship from each other, each said antenna arm being formed without interleaving the other said antenna arm, wherein the output impedance of the television antenna is at least a function of the predetermined distance, a reflector, at least one support connected to said reflector and to said pair of antenna arms, said at least one support providing a separation distance between said reflector and said pair of antenna arms, the front-to-back ratio of said television antenna at least a function of said separation distance.

13. The television antenna of claim 12 where the reflector is a grid of square reflector elements of conductive metal material, the dimensions of each said reflector elements at least being an odd percentage of a wavelength of undesired signal so as to reject said undesired signal.

14. The television antenna of claim 12 wherein said television antenna optimally receives UHF signals in a first orientation and VHF signals in a second orientation.

15. A television antenna comprising:

two antenna arms located opposite each other on an axial axis and separated from each other by a first predetermined distance for receiving broadcast UHF television signals, a pair of phasing stubs, one of said phasing stubs connected to a feed point on one of said antenna arms, a reflector oriented a second predetermined distance on said axial axis from said two antenna arms, said first and second predetermined distances selected to provide a desired output impedance at the phasing stubs of about 300 ohms.

16. The television antenna of claim 15 wherein said two antenna arms form a wedge shape.

17. The television antenna of claim 15 wherein said two antenna arms are of identical and sinuous shape.

18. A UHF television antenna comprising:

a pair of generally sinuous identical antenna arms receiving UHF television signals, said pair of antennas extending outwardly from a common central axis and arranged opposite each other, each antenna arm in said pair of antenna arms comprising a plurality of sinuous cells, each of said plurality of cells having a tapered rotational end terminating on an orientation line, said orientation lines of said pair of antenna arms spaced a first predetermined distance in a parallel relationship to each other, each said antenna arm being formed without interleaving and without touching the other said antenna arm, a pair of phasing stubs, one of said phasing stubs connected to a feed point on one of said antenna elements, a reflector oriented a second predetermined distance on said central axis behind said pair of antenna elements, said first and second predetermined distances selected to provide a desired output impedance at the phasing stubs of about 300 ohms in a bandwidth for UHF signals.

19. The UHF television antenna of claim 18 wherein said pair of antenna arms are formed on a sheet of dialectric material in a plane, said sheet oriented perpendicular to said common central axis.

20. The UHF television antenna of claim 18 where said reflector is a grid of square reflector elements of conductive metal material, the dimensions of each said reflector elements at least an odd percentage of a wavelength so as to reject unwanted signals.

21. The UHF antenna of claim 18 wherein said pair of antenna arms form a wedge shape.

22. The UHF antenna of claim 21 wherein the open end of said wedge shape faces said reflector and wherein said reflector form is a circular shape with the inside of said curve shape facing said open end.

23. A high definition television antenna comprising:

a sheet of polycarbonate material, a pair of generally sinuous antenna arms extending outwardly from a common central axis and arranged opposite each other, said pair of generally sinuous antenna arms formed in a plane on said sheet of polycarbonate material, said plane perpendicular to said common central axis, said pair of generally sinuous antenna arms printed on said sheet with silver conductive ink, each antenna arm in said pair comprising a plurality of sinuous cells, each of said plurality of cells having a rotational end terminating on an orientation line, said orientation lines of said pair of antenna arms spaced a predetermined distance apart in a parallel relationship to each other, each said antenna arm being formed without interleaving the other said antenna arm.

24. The high definition television antenna of claim 23 further comprising:

a reflector plane, said reflector plane having a grid of square reflector elements of silver conductive ink printed on a surface of polycarbonate material, the dimensions of each said reflector elements at least being an odd percentage of a wavelength of an undesired signal so as to reject said undesired signal, at least one support of high dialectric material connected to said reflector plane and to said pair of generally sinuous antenna arms, said at least one support providing a separation distance between said reflector plane and said pair of generally sinuous antenna arms, the front-to-back ratio of said television antenna at least a function of said separation distance.

25. The high definition television antenna of claim 24 wherein said separation distance is less than a separation distance providing optimal front-to-back ratio so that said television antenna is low-profile.

26. A television antenna comprising:

a sheet of polycarbonate material, a pair of generally sinuous antenna arms extending outwardly from a common central axis and arranged opposite each other, said pair of generally sinuous antenna arms formed in a plane on said sheet of polycarbonate material, said plane perpendicular to said common central axis, said pair of generally sinuous antenna arms printed on said sheet with silver conductive ink, each antenna arm comprising a plurality of sinuous cells, each of said plurality of cells having a tapered rotational end terminating on an orientation line, said orientation lines of said two antenna arms spaced at a predetermined distance in a parallel relationship from each other, each said antenna arm being formed without interleaving the other said antenna arm, wherein the output impedance of the television antenna is at least a function of the predetermined distance, a reflector, said reflector having a plurality of reflector elements of silver conductive ink printed on a surface of polycarbonate material, at least one support of high dialectric material connected to said reflector and to said pair of antenna arms, said at least one support providing a separation distance between said reflector and said pair of antenna arms, the front-to-back ratio of said television antenna at least a function of said separation distance.

27. A high definition television antenna comprising:

a pair of generally sinuous identical antenna arms receiving high definition television signals, said pair of generally sinuous antennas extending outwardly from a common central axis and arranged opposite each other, said pair of antenna arms are printed on dialectric material with conductive ink, each antenna arm in said pair of antenna arms comprising a plurality of sinuous cells, each of said plurality of cells having a tapered rotational end terminating on an orientation line, said orientation lines of said pair of antenna arms spaced a first predetermined distance in a parallel relationship to each other, each said antenna arm being formed without interleaving and without touching the other said antenna arm, a pair of phasing stubs, one of said phasing stubs connected to a feed point on one of said antenna elements, a reflector oriented a second predetermined distance on said axial axis behind said pair of antenna elements, said first and second predetermined distances selected to provide a desired output impedance at the phasing stubs of about 300 ohms in a bandwidth for said high definition signals.

28. The high definition television antenna of claim 27 wherein said two antenna arms form a wedge shape.

29. The high definition television antenna of claim 28 wherein the open end of said wedge shape faces said reflector and wherein said reflector form is a circular shape with the inside of said curve shape facing said open end.

* * * * *